US007088948B2

(12) United States Patent
Puckett, Sr. et al.

(10) Patent No.: US 7,088,948 B2
(45) Date of Patent: Aug. 8, 2006

(54) ADJUSTMENT OF SKEW REGISTRATION OF MEDIA TO A DEVELOPED IMAGE IN A PRINTING MACHINE

(75) Inventors: David L. Puckett, Sr., Fairport, NY (US); Mark A. Reeder, Fairport, NY (US); John A. Winterberger, Spencerport, NY (US)

(73) Assignee: Eastman Kodak Company, Rochester, NY (US)

( * ) Notice: Subject to any disclaimer, the term of this patent is extended or adjusted under 35 U.S.C. 154(b) by 199 days.

(21) Appl. No.: 10/881,621

(22) Filed: Jun. 30, 2004

(65) Prior Publication Data

US 2005/0019076 A1 Jan. 27, 2005

Related U.S. Application Data

(60) Provisional application No. 60/485,844, filed on Jul. 9, 2003.

(51) Int. Cl.
*G03G 15/00* (2006.01)

(52) U.S. Cl. ..... 399/395; 399/371; 27/227; 27/228

(58) Field of Classification Search ..... 399/371, 399/395; 400/578, 579; 271/226–229, 265.01, 271/265.02, 265.03, 236
See application file for complete search history.

(56) References Cited

U.S. PATENT DOCUMENTS

| | | | | |
|---|---|---|---|---|
| 4,971,304 | A * | 11/1990 | Lofthus | 271/227 |
| 5,078,384 | A | 1/1992 | Moore | 271/228 |
| 5,094,442 | A | 3/1992 | Kamprath et al. | 271/227 |
| 5,169,140 | A * | 12/1992 | Wenthe, Jr. | 271/228 |
| 5,322,273 | A | 6/1994 | Rapkin et al. | 271/227 |
| 5,555,084 | A * | 9/1996 | Vetromile et al. | 399/16 |
| 6,997,455 | B1 * | 2/2006 | Romine | 271/227 |

* cited by examiner

*Primary Examiner*—Minh Chau

(57) ABSTRACT

A printing machine (10) including a registration station (45) for applying a skew adjustment received from a human operator is disclosed. The registration station (45) includes independently controllable motors (52*a*, 52*b*) that drive corresponding urging rollers (56*a*, 56*b*) as controlled by control circuitry (24), for example in response to the position of a media sheet as sensed by sensors (58*a*, 58*b*; 60*a*, 60*b*) at the registration station (45). The machine operator can enter a skew adjustment value at a user interface (25*a*), or at a networked computer workstation with which the printing machine (10) communicates via a network interface (25*b*). The control circuitry (24) calculates differential control signals for controlling the motors (52*a*, 52*b*) to effect the skew correction. The differential control signals may be differential timing delays, such as prior to deactivation of the motors (52*a*, 52*b*), or may be a differential velocity signal for driving the motors (52*a*, 52*b*).

17 Claims, 7 Drawing Sheets

ADJUSTMENT OF SKEW REGISTRATION OF MEDIA TO A DEVELOPED IMAGE IN A PRINTING MACHINE

CROSS-REFERENCE TO RELATED APPLICATIONS

Priority is hereby claimed to U.S. Provisional Application Ser. No. 60/485,844 entitled "ADJUSTMENT OF SKEW REGISTRATION OF MEDIA TO A DEVELOPED IMAGE IN A PRINTING MACHINE" filed Jul. 09, 2003.

STATEMENT REGARDING FEDERALLY SPONSORED RESEARCH OR DEVELOPMENT

Not applicable.

BACKGROUND OF THE INVENTION

This invention is in the field of printing, and is more specifically directed to high-speed and high-precision electrographic printing.

Electrographic printing has become a prevalent technology in the modern computer-driven printing of text and images, on a wide variety of hard copy media. Tis technology is also referred to as electrographic marking, electrostatographic printing or marking, and electrophotographic printing or marking. Conventional electrographic printers are well suited for high resolution and high speed printing, with resolutions of 600 dpi (dots per inch) and higher becoming available even at modest prices. At these resolutions, modern electrographic printers and copiers are well-suited to be digitally controlled and driven, and are thus highly compatible with computer graphics and imaging. Examples of conventional printing machines with this capability include the DIGIMASTER 9110 network imaging system and the DIGIMASTER 9150i digital press, both available from Heidelberg USA, Inc.

A typical electrographic printer includes a primary image forming photoconductor, which may be a moving belt in large scale printers, or a rotating drum in smaller laser printers and photocopiers. The photoconductor is initially sensitized or conditioned by the application of a uniform electrostatic charge at a primary charging station in the printer. An exposure station forms an image on the sensitized photoconductor by selectively exposing it with light according to the image or text to be printed. The exposure station may be implemented as a laser, an array of light emitting diodes (LEDs), or a spatial light modulator. In modern electrographic printing, a computer typically drives the exposure station in a raster scan manner according to a bit map of the image to be printed. The exposing light discharges selected pixel locations of the photoconductor, so that the pattern of localized voltages across the photoconductor corresponds to the image to be printed.

At a developing or toning station in the typical electrographic printer, a developer roller or brush is biased to a bias voltage roughly at the primary charging voltage of the sensitized photoconductor prior to exposure. The biased developer roller or brush is loaded with toner, which is typically a mixture of a fine metallic powder with polyester resin and powdered dye, charged to the bias voltage. As the exposed photoconductor passes the developing station, toner is attracted to the discharged pixel locations of the photoconductor. As a result, a pattern of toner corresponding to the image to be printed appears on the photoconductor. This pattern of toner is then transferred to the medium (e.g., paper) at a transfer station. The transfer station charges the medium to an opposing voltage, so that the toner on the photoconductor is attracted to the medium as it is placed in proximity to the photoconductor.

The transferred toner becomes permanently fixed to the medium at the a fusing, or fixing, station that is located downstream from the transfer station. Conventional fusing stations apply heat and pressure to fuse the transferred toner to the medium, after which the then-printed medium travels to a finishing station in the printer for collating, sorting, stapling or other binding, and other finishing operations.

As mentioned above, modern electrographic printers have extremely high resolution capability. The high resolution that is achievable in the formation of the image on a medium has translated into stringent mechanical requirements on the remainder of the printing machine, including stringent requirements in the precision with which the medium is positioned relative to the photoconductor at the transfer station.

The overall precision of the image formation and mechanical positioning in modern printing machines is of special concern in certain printing applications. One example of a printing application with extreme position is the printing of election ballots that are to be machine read after marking by the voter. Anti-counterfeiting measures implemented by ballot reading machines rely upon extremely precise positioning of printed identifiers on the ballot; for example, modern ballot reading machines typically discard, as counterfeit, those ballots having their identifiers mispositioned by as little as twenty thousandths of an inch. Another printing application that requires extremely high precision is the printing of high-quality images on pre-printed media, in which the printed images may be required to be very precisely positioned relative to the existing images and text.

One important parameter in the positioning of media in a printing machine is referred to as "skew". Skew refers to error in the rotational positioning, or angular deviation, of a sheet of the media to be printed at the transfer station. FIG. 1 illustrates the effect of skew in a conventional printing machine, for example in the positioning of sheet 2 at a transfer station in the printing machine. Sheet 2 is a sheet of paper or another medium, to which an image is to be transferred from a developed region of a photoconductor. In the illustration of FIG. 1, sheet 2 is skewed, or rotationally misaligned, such that the center line CL of sheet 2 along its major vertical axis has an angular deviation relative to the path center line PCTR. Path center line PCTR refers to the center line of a transport path of media in the printing machine, and thus to the center line of the imaged portion of the photoconductor. In the printing art, measurement of skew is defined by the horizontal distance between the horizontal position of center line CL at the top of sheet 2 to the horizontal position of center line CL at the bottom of sheet 2. This measured skew is shown as distance SKEW in FIG. 1.

In conventional printing machines, skew is controlled by way of one or more motors at a registration station that feeds sheets of media to the transfer station. U.S. Pat. No. 5,322,273, incorporated herein by this reference, describes an example of a conventional registration mechanism for placing sheets of a medium to be printed in registration with a photoconductor in a conventional printing machine. According to this conventional approach, a pair of motors are laterally separated from one another, and advance each sheet along the path toward the transfer station and photoconductor. These motors are individually and differentially controlled in response to the sensed position of the sheet along the path to remove skew in the medium relative to the path.

FIG. 2 schematically illustrates the operation of conventional registration stations, such as that described in U.S. Pat. No. 5,322,273. Sheet 2 is illustrated as being advanced along the path (having path center line PCTR) by rollers 6*a*, 6*b*. Rollers 6*a*, 6*b* are advancing rollers driven by individual motors, and controlled in the manner described in U.S. Pat. No. 5,322,373. Laterally separated sensors 5*a*, 5*b* sense the leading edge of sheet 2 as it is advanced along the path. In the example of FIG. 2, sensor 5*b* will detect a leading edge of sheet 2 earlier in time than will sensor 5*a*. A control circuit (not shown) receives signals from sensors 5*a*, 5*b*, and controls the motors driving rollers 6*a*, 6*b* accordingly to remove the skew. In this example, the conventional printing machine described in this U.S. Pat. No. 5,322,273 eliminates this skew by deactivating the motor driving roller 6*b* (for example, upon sensor 5*b* detecting the leading edge of sheet 2) to hold sheet 2 in position at the point of contact of roller 6*b*, and continuing to drive roller 6*a* to rotate sheet 2 for an additional time (for example, until sensor 5*a* detects the leading edge of sheet 2). The driving of roller 6*a* with roller 6*b* stopped will effect a rotation of sheet 2, in the clockwise direction in the example of FIG. 2, correcting the angular deviation of sheet 2 relative to path center line PCTR.

By way of further background, another approach to the elimination of skew in printing machines involves the differential driving of laterally spaced rollers to different velocities, responsive to a skew measurement. U.S. Pat. No. 5,078,384 and U.S. Pat. No. 5,094,442, both incorporated by reference herein, describe this differential velocity approach. According to this conventional control method, referring to FIG. 2, the control circuit computes the extent of skew of sheet 2 from signals that it receives from sensors 5*a*, 5*b*, and controls the motors driving rollers 6*a*, 6*b* such that roller 6*a* rotates faster than roller 6*b*, in the skew example of FIG. 2. This differential velocity will effectively rotate sheet 2 to eliminate the skew by the time that sheet 2 exits the registration station.

While these conventional printing machines are effective to remove skew to a significant degree, it has been observed in connection with this invention that the ultimate precision with which the skew is eliminated is still limited, especially relative to the extremely high precision required for some modern printing jobs, as mentioned above. Furthermore, while the precision of skew compensation in these conventional printing machines can be adjusted, such adjustment requires a service technician to take down the machine and effect the specific adjustment. Especially in the context of a print shop environment, this adjustment typically necessitates a service call, thus involving significant cost, as well as machine downtime (at least for precision printing jobs) while awaiting the service technician.

BRIEF SUMMARY OF THE INVENTION

It is therefore an object of this invention to provide a printing machine in which the user can adjust the position of images as transferred to the media.

It is a further object of this invention to provide such a printing machine in which the user can precisely adjust the skew of the printed media.

It is a further object of this invention to provide such a printing machine in which the user can easily interface with the printing machine to effect the skew adjustment.

Other objects and advantages of this invention will be apparent to those of ordinary skill in the art having reference to the following specification together with its drawings.

The present invention may be implemented into an electrographic printing machine, having a programmable controller for controlling the mechanical operation of the transfer station. The printing machine includes a human interface, such as a software "applet", by way of which the human user can interactively enter a skew adjustment. The programmable controller effects the desired skew adjustment by adjusting the operation of independent positioning motors at a registration station in the printing machine, rotating the media sheet as it is forwarded toward the photoconductor.

DETAILED DESCRIPTION OF THE INVENTION

The preferred embodiment of this invention will now be described in connection with its preferred embodiment. In this example, the preferred embodiment of the invention is a registration station upstream from a transfer station in an electrographic printer, considering that this invention is contemplated to be particularly beneficial in such an application. It will be appreciated by those skilled in the art having reference to this specification that this invention can also be used in any type of electrographic system, of any size or capacity, at any point in the machine at which precise positioning of media is desired. As such, this description is provided by way of example only, and is not intended or contemplated to limit the true scope of the invention as claimed.

Figure 1:
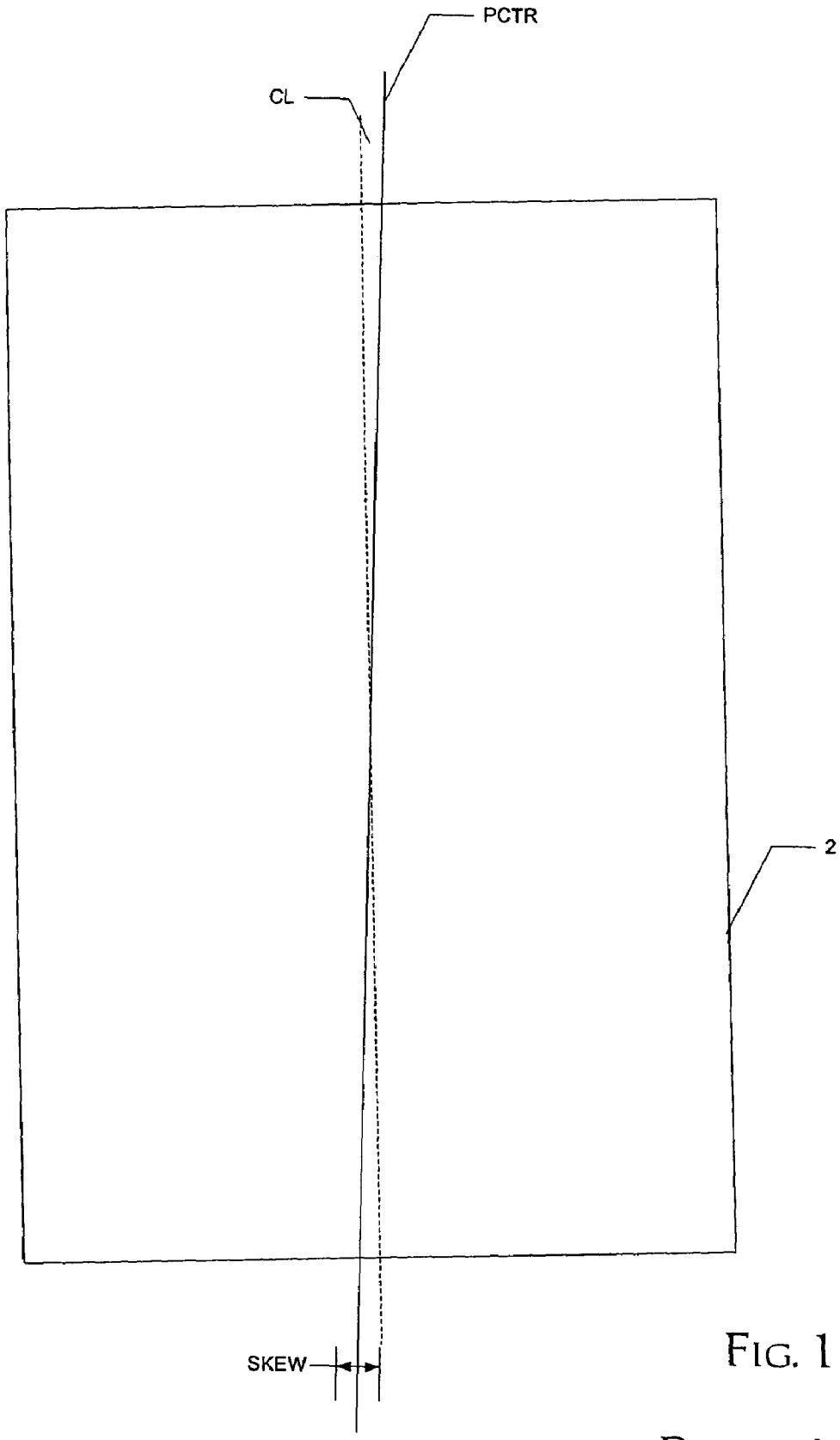
FIG. 1 PRIOR ART
FIG. 1 is a schematic diagram illustrating the effects of skew of a sheet of a medium to be printed by an electrographic printing machine.
Figure 2:
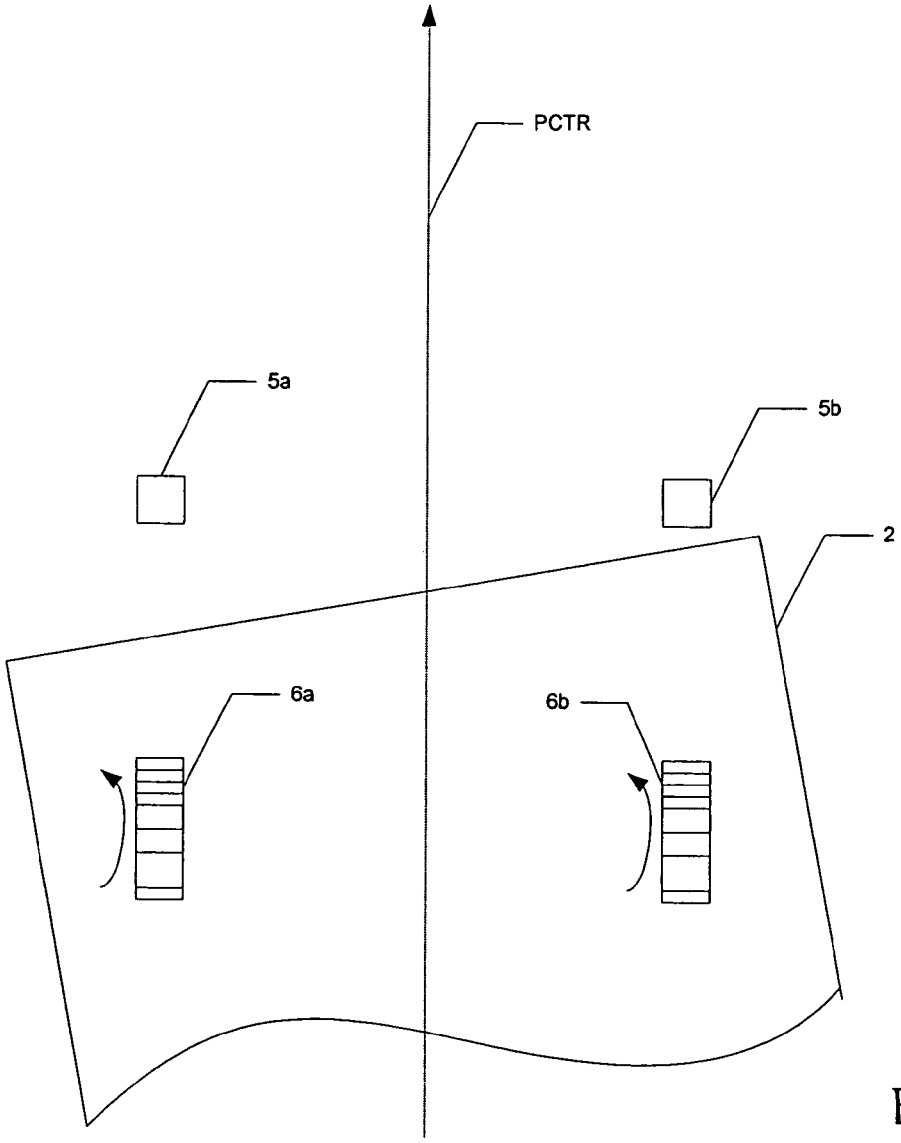
FIG. 2 PRIOR ART
FIG. 2 is a schematic diagram illustrating a conventional mechanism for eliminating the skew of a sheet of a medium to be printed in a conventional electrographic printing machine.
Figure 3:
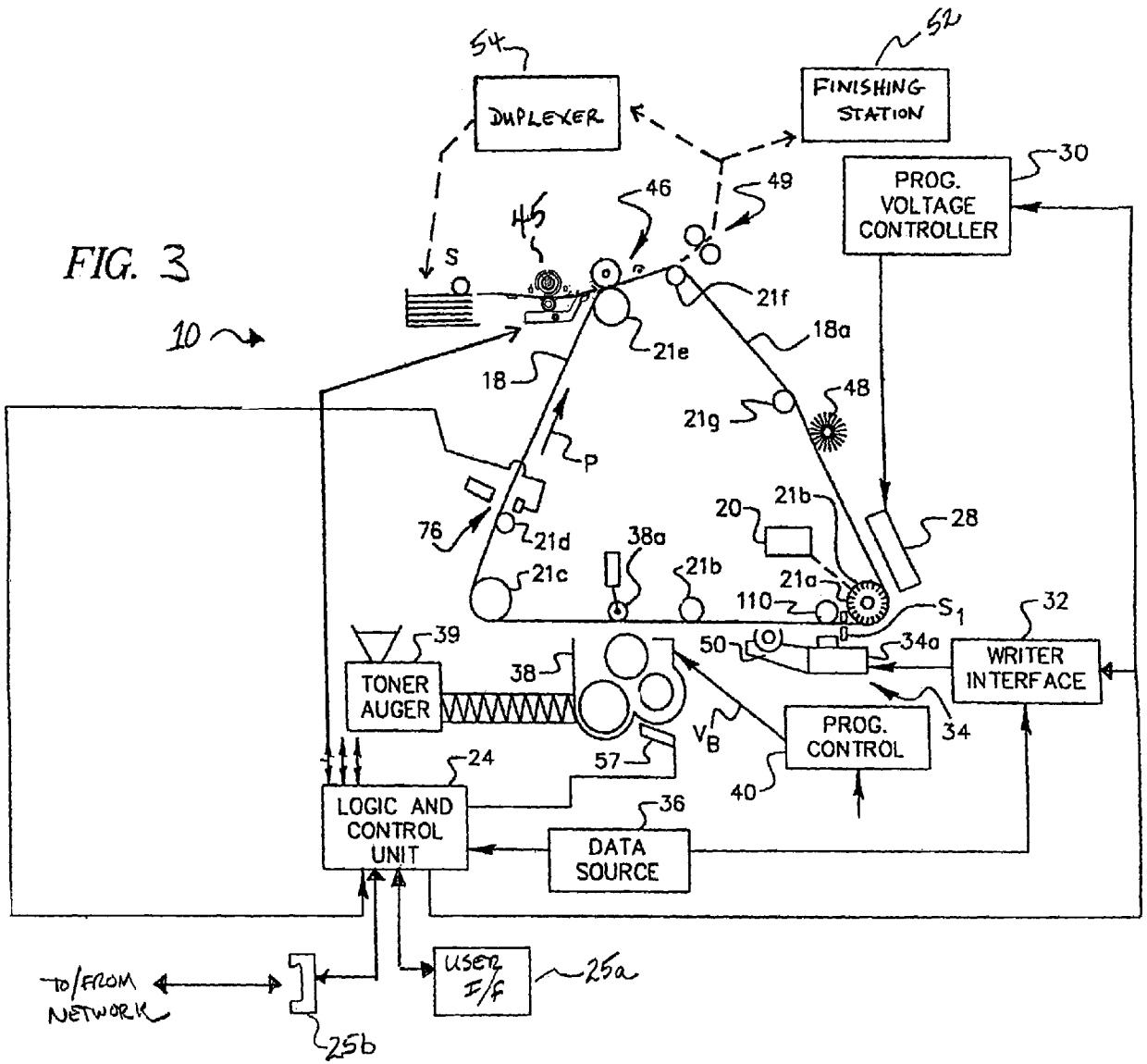
FIG. 3 is a schematic diagram, in block form, of a printing machine constructed according to the preferred embodiment of the invention.

Referring now to FIG. 3, printer machine 10 according to the preferred embodiment of the invention will now be described. In electrographic printer machine 10 of FIG. 3, a moving recording member such as a photoconductive film belt 18 is entrained about a plurality of rollers or other supports 21*a* through 21*g*, one or more of which is driven by a motor to advance the belt. By way of example, roller 21*a* is illustrated as being driven by motor 20. Motor 20 preferably advances the belt at a high speed, such as 20 inches per second or higher, in the direction indicated by arrow P, past a series of workstations of the printer machine 10. Alternatively, photoconductor 18 may be wrapped and secured about only a single drum. Still further in the alternative, photoconductor 18 may be implemented by way of a drum having a photoconductive surface.

Printer machine 10 includes logic and control unit (LCU) 24, preferably a digital computer or microprocessor operating according to a stored program for sequentially actuating the workstations within printer machine 10, effecting overall control of printer machine 10 and its various subsystems. LCU 24 is also programmed to provide closed-loop process control of printer machine 10 in response to signals from various sensors and encoders, in the conventional manner. In this manner, LCU 24 provides overall control of the apparatus and its various subsystems as is well known. LCU 24 will typically include temporary data storage memory, a central processing unit, timing and cycle control unit, and stored program control.

This description will frequently refer to LCU 24 as carrying out various computation and control functions and tasks. It is contemplated that those skilled in the art having reference to this specification will comprehend that LCU 24 may actually be implemented as a single microprocessor-based computer within printing machine 10, or alternatively by way of multiple microprocessors or microcontrollers distributed throughout printing machine 10, or alternatively by some other logic and control architecture. It is therefore to be understood that the references in this specification to LCU 24 as performing certain computation and control functions and tasks refers to logic and control circuitry in this general sense, and that these references are not to be interpreted as limiting the logic and control circuitry used in connection with this invention to any particular architecture or implementation.

Inputs to LCU 24 can be received by an input data processor or through an interrupt signal processor, and include input signals from various switches, sensors, and analog-to-digital converters internal to printing machine 10. LCU 24 may also receive inputs from sources external to printing machine 10, such from as a human user or over a computer network. According to the preferred embodiment of the invention, one source of such input signals is human interface 25*a*, which is a conventional touch screen or other input/output device that is coupled to LCU 24, by way of which the human operator can view the status of printing machine 10, enter selections for a print job, and control LCU 24 to execute utility applets for setting up and otherwise controlling printing machine 10. Alternatively, LCU 24 may receive inputs from a remote computer workstation, communicating with printing machine 10 via network interface 25*b*. In any case, LCU 24 controls the operation of printing machine 10 by way of control signals that are applied to suitable output drivers, and in turn to the appropriate subsystems within printing machine 10.

Primary charging station 28 in printer machine 10 sensitizes photoconductor 18 by applying a uniform electrostatic corona charge, from high-voltage charging wires at a predetermined primary voltage to surface 18*a* of photoconductor 18. Other forms of chargers, including brush or roller chargers, may also be used. This operation prepares a portion of photoconductor 18 for receipt of image information, which in this case is applied by exposure station 34 selectively discharging of locations of photoconductor 18.

At exposure station 34, writer 34*a*projects light in a selected pattern to photoconductor 18. This light selectively dissipates the electrostatic charge on photoconductive photoconductor 18 to form a latent electrostatic image of the document to be copied or printed. Writer 34*a*is preferably constructed as an array of light emitting diodes (LEDs), or alternatively as another light source such as a laser or spatial light modulator. In any case, writer 34*a*exposes individual picture elements (pixels) of photoconductor 18 with light at a regulated intensity and exposure according to the image data to be printed, communicated from data source 36 via writer interface 32. Data source 36 is contemplated to be a computer or microcontroller, itself storing a bit map for the image in its own memory or receiving the bit map over a data network. The pattern of the image to be formed is applied to writer interface 32, along with control signals from logic and control unit 24 that indicate the position of photoconductor 18 at which this image is to be formed.

After exposure, the portion of photoconductor 18 bearing the latent charge images travels to development station 38. As conventional in the art, in this example, development station 38 includes a magnetic brush in juxtaposition to, but spaced from, the travel path of photoconductor 18. Alternatively, other known types of development stations or devices may be used, or plural development stations 38 may be provided for developing images in plural colors, or using toners having different physical characteristics.

Upon the imaged portion of photoconductor 18 reaching development station 38, LCU 24 selectively activates development station 38 to apply toner to photoconductor 18. Preferably, this activation is effected by LCU 24 controlling a mechanism to move backup roller 38*a*, and thus photoconductor 18, into engagement with or close proximity to the magnetic brush. Alternatively, the magnetic brush may be moved toward photoconductor 18 to selectively engage photoconductor 18. In either case, charged toner particles on the magnetic brush are selectively attracted to the latent image patterns present on photoconductor 18, developing those image patterns. As known in the art, conductor portions of development station 38, such as conductive applicator cylinders, are biased to act as electrodes. Examples of the developer mix used at development station include a two-component mix having a dry mixture of toner and carrier particles; alternatively, a single component developer or a conventional liquid toner may be used. Toner is supplied to development station 38 by motor-driven toner auger 39, under the control of LCU 24.

Registration station 45 in printing machine 10 move sheets of the media to be printed from source S into engagement with photoconductor 18, in registration with a developed image in a frame of photoconductor 18. Transfer station 46 then transfers the developed image from photoconductor 18 to the media sheet. The media printed by printing machine 10 may be plain or coated paper, plastic, transparency material, or another medium capable of being printed upon by printer machine 10. Typically, transfer station 46 includes a charging device for electrostatically biasing movement of the toner particles from photoconductor 18 to the receiving sheet. In this example, the biasing device is roller 46*b*, which engages the back of the media sheet and which is connected to programmable voltage controller 46*a* that operates in a constant current mode during transfer. Alternatively, an intermediate member may have the image transferred to it and the image may then be transferred to the media.

Registration station 45 controls the positioning of the media sheets at transfer station 46, so that each sheet reaches transfer station 46 in registration with a corresponding developed image on photoconductor 18. This registration includes registration in the in-track and cross-track directions, and also includes the correction of skew of the media sheets relative to the desired path of travel. The particular construction and operation of registration station 45 according to the preferred embodiment of the invention will be described in further detail below.

Cleaning station 48, such as a brush, blade, or web as is well known, is also located behind transfer station 46, and removes residual toner from photoconductor 18. A pre-clean charger (not shown) may be located before or at cleaning station 48 to assist in this cleaning. After cleaning, this portion of photoconductor 18 is then ready for recharging and re-exposure. Of course, other portions of photoconductor 18 are simultaneously located at the various workstations of printing machine 10, so that the printing process is carried out in a substantially continuous manner.

After leaving transfer station 46, each printed sheet is detacked from photoconductor 18. At this point, the sheet is carrying a pattern of toner corresponding to the image to be printed as defined by the charge pattern written at exposure station 34. This toner is not yet fused to the sheet at this point, but instead electrostatically adheres to the sheet. The imaged sheet then travels to fusing station (fuser) 49 where the image is fixed to the sheet. After fusing at fuser 49, the printed sheets then pass to finishing station 52 for collating, sorting, stapling, or the like, or alternatively pass to duplexer 54 if the opposite side of the printed sheets are also to be printed.

Figure 4:
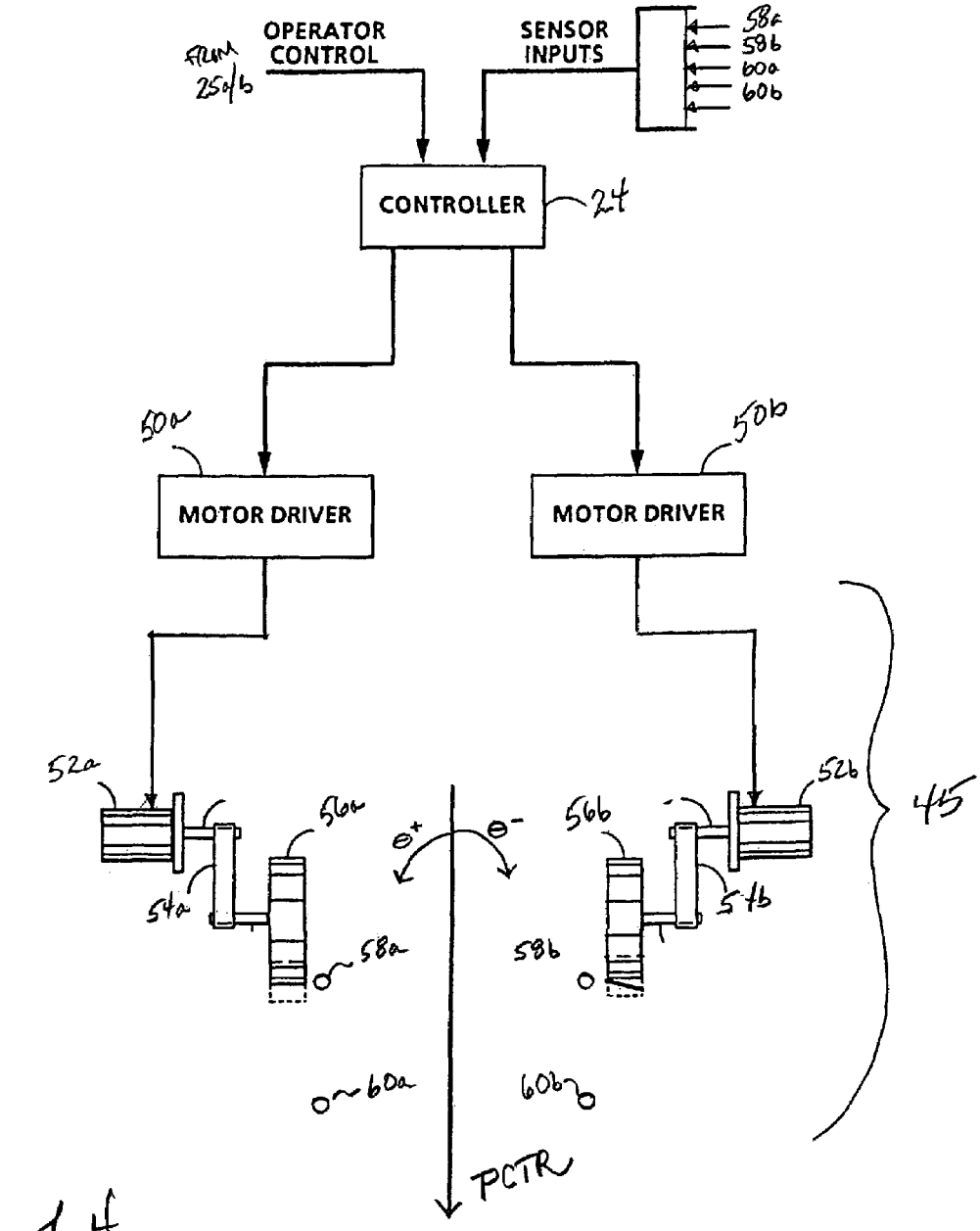
FIG. 4 illustrates, in block and schematic form, a registration station, and its control circuitry, in the printing machine of FIG. 3 according to the preferred embodiment of the invention.

Referring now to FIG. 4, the construction of registration station 45 according to the preferred embodiment of the invention will now be described in further detail. Registration station 45 includes two stepper motors 52*a*, 52*b*, each driving a respective gear 54*a*, 54*b*, which in turn drives a corresponding urging roller 56*a*, 56*b*. Urging rollers 56*a*, 56*b* are each constructed in the conventional manner in the art. As described in the above-incorporated U.S. Pat. No. 5,322,273, each urging roller 56 has an arcuate peripheral segment extending about 180 degrees around the roller axis, of a radius to reach the plane of the transport path along which the medium will travel. Other conventional features of registration station 45 includes sensors (not shown) that can sense the return of each urging roller 56 to a "home" position when deactivated, and of course the necessary support structure to which rollers 56, gears 54, and motors 52 are attached and properly positioned relative to the transport path. Additional detail regarding a preferred construction of registration station 45 is provided in the above-incorporated U.S. Pat. No. 5,322,273.

Registration station 45 also includes sensors 58*a*, 58*b*, 60*a*, 60*b* located at the plane of the transport path. Sensors 58, 60 are of conventional construction, and may be either optical or mechanical sensors as known in the art. Sensors 58*a*, 58*b* are paired with one another, and are laterally separated from one another along an axis that is perpendicular to the path center line PCTR, and that is positioned at or in advance of the position of urging rollers 56*a*, 56*b* relative to the transport path. Sensors 60*a*, 60*b* are similarly laterally separated from one another along an axis that is perpendicular to the path center line PCTR, but are downstream from sensors 58*a*, 58*b*. Preferably, sensors 58*a*, 60*a* are positioned along a line that is parallel to path center line PCTR, and similarly sensors 58*b*, 60*b* are positioned along a line that is also parallel to path center line PCTR but on an opposite side from the line defined by sensors 58*a*, 58*b*. Those skilled in the art having reference to this specification will comprehend that the positioning and numbers of sensors 58, 60 are somewhat arbitrary, so long as the presence and extent of skew of media registered by registration station 45 can be detected and measured. For example, offsets in the position of sensors can be calibrated out by LCU 24 or other computing circuitry in printing machine 10; especially considering the high precision required of printing machine 10 according to this invention, such calibration is preferably performed even if the desired location of sensors 58, 60 are arranged in the manner illustrated in FIG. 4.

As described in the above-incorporated U.S. Pat. No. 5,322,273, U.S. Pat. No. 5,078,384, and U.S. Pat. No. 5,094,442, additional sensors may be deployed at registration station 45. These additional sensors are useful in connection with other registration functions, such as cross-track alignment and in-track alignment, as known in the art.

Referring back to FIG. 4, sensors 58*a*, 58*b*, 60*a*, 60*b* generate electrical signals according to whether a sheet of media to be printed is located at the corresponding positions. These signals are forwarded by sensors 58*a*, 58*b*, 60*a*, 60*b* to LCU 24. In connection with this description, LCU 24 refers not only to a programmable controller for controlling the operation of some or all of printing machine 10, but also refers to other support circuitry such as data converters, amplifiers, interface circuitry, clock and control circuitry, and the like. In any event, LCU 24 is capable of detecting the arrival of a leading edge of a medium sheet, for example by sampling these signals over time and comparing the sampled signals. This implementation of this detection, including the storing and processing of the time-domain events based on these signals, may be readily implemented by those skilled in the art having reference to this specification, and as such no additional description of those functions and circuitry will be presented here.

LCU 24 generates output control signals that are forwarded to motor drivers 50*a*, 50*b*, which in turn are associated with and control stepper motors 52*a*, 52*b*, respectively. In this manner, LCU 24 effects closed loop control of stepper motors 52*a*, 52*b*, at least partially in response to signals from sensors 58, 60 and other sensors within registration station 45. Such control is also contemplated to be under programmable control, as known in the art.

According to this preferred embodiment of the invention, LCU 24 is also coupled to receive, directly or indirectly, skew control inputs from a human operator via human interface 25*a*, network interface 25*b*, or the like. As will be described in further detail below, these skew control inputs provide LCU 24 with adjustment values, by way of which it controls the operation of motors 52*a*, 52*b*, and thus urging rollers 56*a*, 56*b*, respectively, to finely and precisely adjust the skew of media registered by registration station 45 on the path to transfer station 46 in printing machine 10. A preferred example of this operation of LCU 24, according to this preferred embodiment of the invention, to provide precise skew adjustment will now be described in detail relative to FIGS. 5, 6, 7*a*, and 7*b*.

Figure 5:
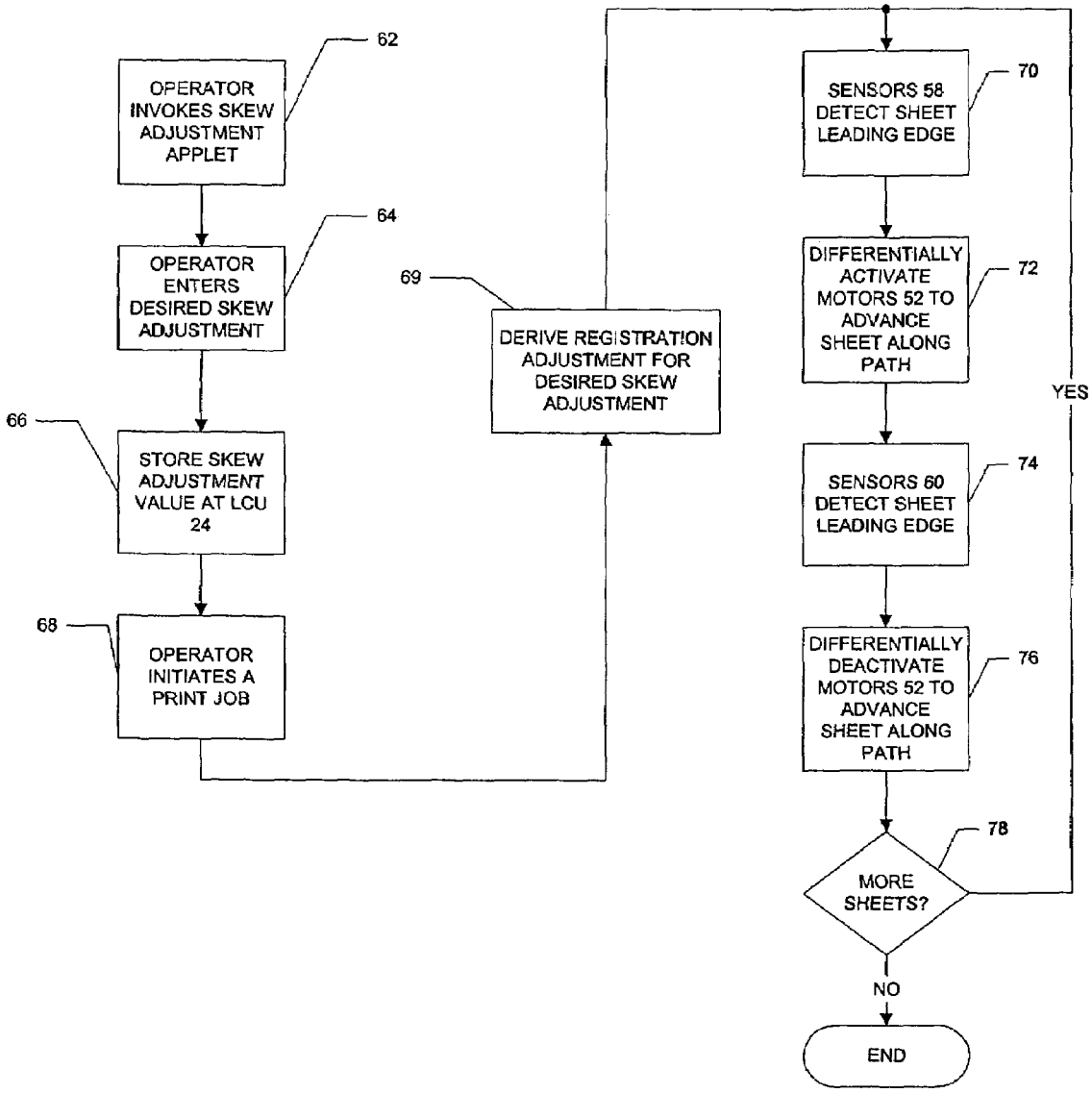
FIG. 5 is a flow chart illustrating the operation of the registration station and control circuitry of FIG. 4 in effecting skew adjustment, according to the preferred embodiment of the invention.

FIG. 5 is a flow diagram of the overall method of precision skew adjustment according to the preferred embodiment of the invention. The method begins, in process 62, with the operator invoking an applications program (or "applet") to be executed by printing machine 10. This applet is contemplated to be a relatively simple computer program, executable for example by LCU 24 of printing machine 10, by way of which printing machine 10 requests and receives a desired skew adjustment value from a human operator. The particular manner in which the applet communicates with the operator will depend, of course, upon whether the human operator invoked the applet from user interface 25*a* of printing machine 10 itself, or by way of a computer workstation that is networked to printing machine 10 by way of network interface 25*b*.

Figure 6:
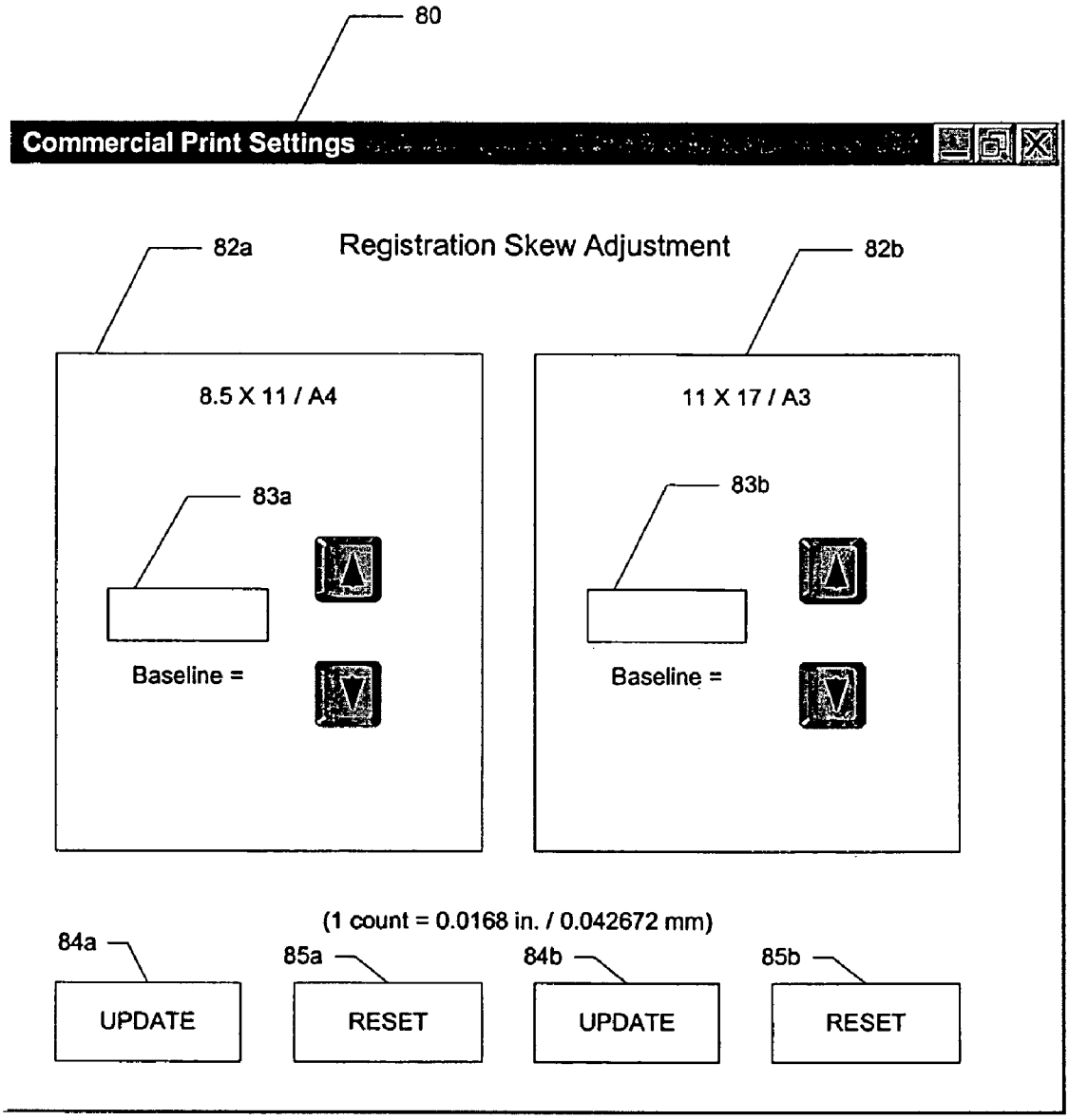
FIG. 6 illustrates a display screen at a user interface by way of which an operator enters skew adjustment parameters according to the preferred embodiment of the invention.

In either event, a display screen is presented to the operator to request and interactively receive the skew adjustment value. FIG. 6 illustrates an example of such a display, in the form of an LCD pattern at user interface 25*a*, or by way of a "window" displayed at the operator's workstation if communications are carried out over the network via network interface 25*b*. In this example, applet window 70 provides two subwindows 82*a*, 82*b*, for receiving a skew adjustment value from the operator for different paper sizes. As mentioned above, skew is measured by the horizontal distance between the center point of the top of a medium sheet and the center point of the bottom of that sheet; as such, the skew measurement depends on the length of the medium. Accordingly, the skew adjustment by the operator presumes a sheet length. Subwindow 82*a* is thus provided for 8½ by 11 inch paper (also for A4 paper, which is approximately that sizet), and subwindow 82*b* is provided for larger paper such as 11 by 14 inch paper, or A3 paper. Each subwindow 82*a*, 82*b* includes a numerical entry field 83*a*, 83*b*, respectively, by way of which an skew adjustment value may be entered by the operator.

In this example, process 64 (FIG. 5) is then performed, by way of which the human operator enters a skew adjustment value into the appropriate location of window 70. In the exemplary window 70 of FIG. 6, the skew adjustment value is entered by the operator "clicking" (either by touch pad entry or pointing device operation, depending upon the environment) on the upward or downward pointing arrows within the desired subwindow 82*a*, 82*b* corresponding to the desired paper size. Each "click" of one of the arrows increments a positive or negative skew adjustment count, which corresponds to a stepped skew adjustment value in either rotational direction (e.g., θ+ and θ−, respectively, of FIG. 4). In this example, each count corresponds to a skew adjustment of 0.0168 inches, or 0.042672 mm, providing extremely fine adjustment of skew. In an exemplary implementation of this invention, the applet permits the operator to select up to ±12 such increments, providing a maximum skew correction of about 0.020 inches. Upon the operator having advanced the count to the desired skew adjustment value, process 64 is terminated by the operator clicking the appropriate "update" button 84*a*, 84*b* for the corresponding paper size. As shown in FIG. 6 for this example, each subwindow 82*a*, 82*b* has a corresponding "reset" button 85*a*, 85*b* by way of which a null skew adjustment (which is set by the field service engineer) can be immediately reentered for the corresponding paper size.

Referring back to FIG. 5, the desired skew adjustment value entered in process 64 is next stored by LCU 24, in process 66. The operator then effects such other settings as desired for the next print job, and then initiates printing of the print job in process 68. As printing machine 10 then begins the printing process in the conventional way, LCU 24 executes process 69 to derive the appropriate adjustment for registration station 45, based on the desired skew adjustment. The nature of the appropriate registration adjustment depends on the manner in which LCU 24 actually effects the adjustment of registration station 45 to modify its skew control as desired. According to the preferred embodiment of the invention, as will be described in further detail, registration station 45 performs its normal skew control by its timing of the stepper motors, as described in the above-incorporated U.S. Pat. No. 5,322,273, in which case the registration adjustment calculated in process 69 is a timing adjustment to be applied in the skew control at registration station 45. Alternatively, if registration station 45 effects slew control by differential velocities for its stepper motors, as described in the above-incorporated U.S. Pat. No. 5,078,384 and U.S. Pat. No. 5,094,442, the registration adjustment derived in process 69 will be an adjustment to one or both of the stepper motor velocities.

In the general case, once the print job is initiated (process 68) and the timing adjustment derived (process 69), skew adjustment according to the preferred embodiment of the invention is effected as a medium sheet as it is advanced through registration station 45. At this point, skew adjustment is then effected by LCU 24 differentially controlling stepper motors 52*a*, 52*b* by an amount corresponding to the desired skew adjustment value entered by the operator. This differential control skews the medium sheet by the desired amount as it is forwarded by registration station 45 to transfer station 46, thus skewing the sheet in such a manner as to receive the exposed image at the precisely defined location specified by the skew adjustment value. Process 69 according to the preferred embodiment of the invention will be described in further detail below.

In carrying out the print job, printing machine 10 of course advances sheets of the appropriate media (e.g., paper stock) from the paper supply S through registration station 45 to transfer station 46, at which point the exposed and developed image is transferred to each sheet. In this embodiment of the invention, registration station 45 carries out its operation upon sensors 58 detecting the leading edge of a media sheet in process 70. As described above, in this embodiment of the invention, motors 52*a*, 52*b* are independently activated in response to the sensing of the leading edge of the sheet, causing urging rollers 56*a*, 56*b* to advance the sheet along the transfer path, in process 72. Other registration actions may also be effected at this time, including in-track and cross-track registration of the media sheet. Upon the detection of the leading edge of the sheet by downstream sensors 60 in process 74, the skew correction and adjustment according to the preferred embodiment of the invention is effected by control of motors 52*a*, 52*b* in process 76.

Figure 7:
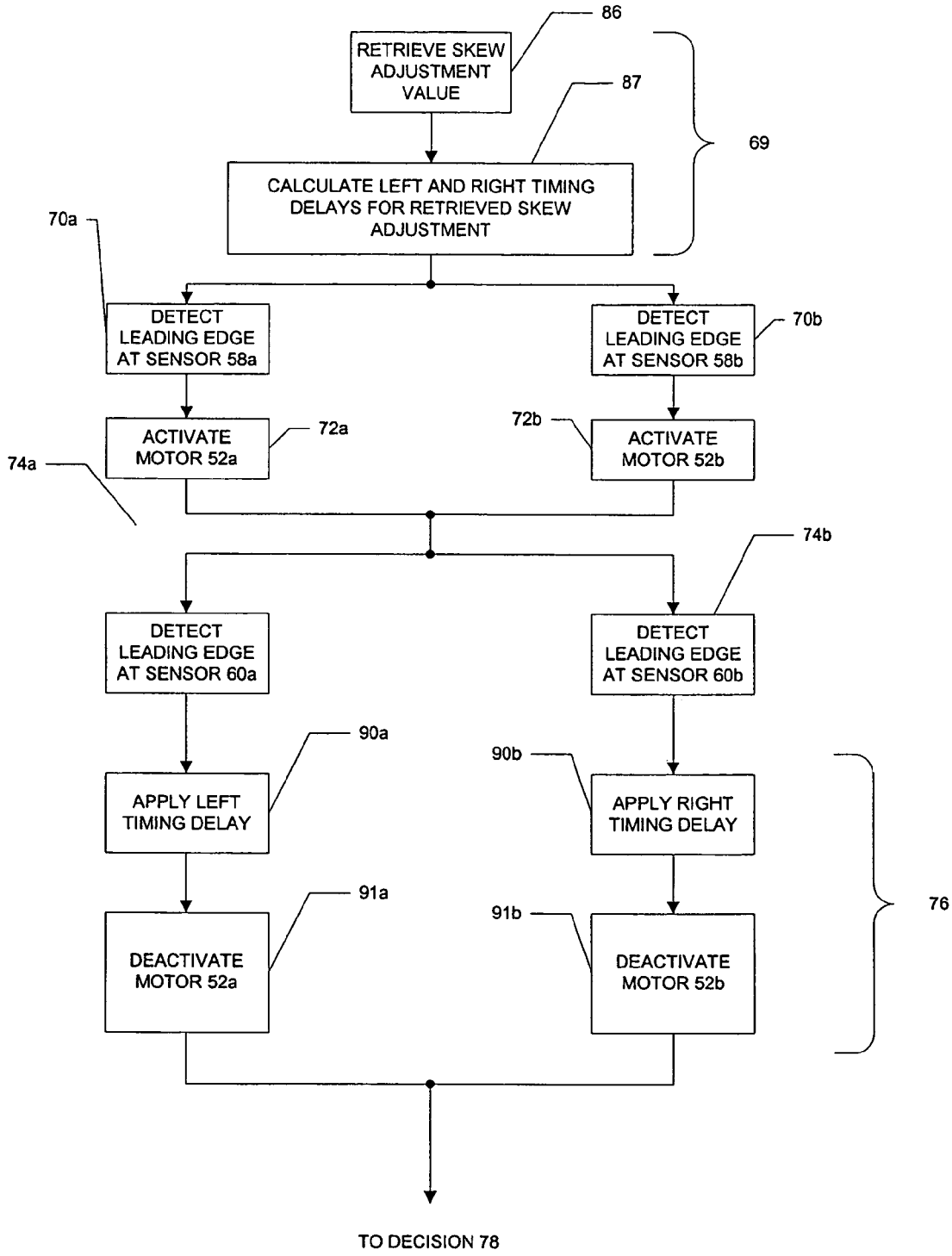
FIG. 7 is a flow diagram illustrating the operation of skew adjustment as carried out by adjusting delays in the deactivating of stepper motors at the registration station, according to the preferred embodiment of the invention.

Referring now to FIG. 7, an example of the differential deactivating of stepper motors 52*a*, 52*b* to effect a desired skew adjustment value according to the preferred embodiment of the invention will now be described, relative to an exemplary implementation of processes 69 through 76 of the process of FIG. 5. As shown in FIG. 7, process 69 begins with process 86, in which LCU 24 retrieves the skew adjustment value that was input by the operator in process 64, and that was stored at or by LCU 24 in process 66.

According to this embodiment of the invention, LCU 24 next calculates the appropriate timing delays in the deactivating of motors 52*a*, 52*b*, thus skewing the media at registration station 45 according to the retrieved skew adjustment value, in process 87. Referring back to FIG. 4, as a media sheet is advanced through registration station 45 (FIG. 4 being a top-down plan view of station 45), differences in the duration of the urging by rollers 56*a*, 56*b* will effect a rotation of the sheet. Specifically, if the deactivation of motor 52a and thus urging roller 56*a* is delayed, relative to motor 52*b* and urging roller 56*b*, the sheet of media will be rotated in the θ+ direction. Conversely, a differential delay in the activation of motor 52*b* and urging roller 56*b*, relative to motor 52*a* and urging roller 56*a*, will rotate the sheet in the θ− direction.

As described above and in the above-incorporated U.S. Pat. No. 5,322,273, registration station 45 according this embodiment of the invention activates its motor 52*a* upon the leading edge of a media sheet being detected by sensor 58*a*, and activates motor 52*b* upon the leading edge of the sheet being detected by sensor 58*b*. Registration station 45 also deactivates its motor 52*a* upon the leading edge of the sheet being detected by sensor 60*a*, and deactivates motor 52*b* upon the leading edge being detected by sensor 60*b*; this independent deactivation of motors 52*a*, 52*b* removes skew in the media as it is advanced by registration station 45 to transfer station 46 in printing machine 10. In process 69, LCU 24 calculates adjustments to the timing of the deactivation of motors 52 by times corresponding to the skew adjustment distance entered by the operator in process 64, thus effecting the desired adjustment.

Preferably, according to this embodiment of the invention, a null delay time for the deactivation of motors 52*a*, 52*b* is implemented by LCU 24 via motor drivers 50*a*, 50*b*, respectively. This permits LCU 24 to either advance or delay the deactivation of motors 52, relative to this null delay time. Accordingly, in process 87, LCU 24 calculates left and right timing delays that modify the delay time between the sensing of a leading edge of a media sheet by sensors 60*a*, 60*b* and the deactivating of motors 52*a*, 52*b*, respectively. In effect, process 87 carries out a conversion of the skew adjustment distance entered by the operator in process 64 into a timing difference in the control of motors 52*a*, 52*b* that will effect the appropriate rotation (or change in rotation), resulting in the desired precision adjustment of the skew. It is contemplated that those skilled in the art will be readily able to implement the appropriate computer program executed by LCU 24 to effect the calculation of process 87, considering the inputs from the operator in process 64 involving the desired skew adjustment and the length of the media.

The left and right timing delays calculated in process 87 may be implemented in various ways. For example, the calculated timing delays may advance the deactivation of one of motors 52*a*, 52*b* and retard the deactivation of the other, by decrementing the delay time from the null value for the advanced one of motors 52*a*, 52*b* and incrementing the delay time from the null value for the other. Alternatively, the calculated timing delay may be applied to only one of motors 52*a*, 52*b*, by either adding delay to or subtracting delay from the null value for one motor, while making no change to the deactivation delay of the other motor. It is contemplated that those skilled in the art having reference to this specification will be readily able to implement the calculation of the timing delays to effect the skew adjustment in any one of these, or other, approaches for each particular application.

As described above, the control of motors 52*a*, 52*b* is effected substantially independently from one another, regardless of the relative timing of the sensed leading edges. Accordingly, as shown in FIG. 7, the left and right activation and deactivation processes are performed independently, in no sequential order relative to one another. The activation of each of motors 52*a*, 52*b* is effected by its respective sensor 58*a*, 58*b* detecting the leading edge of the media sheet (in processes 70*a*, 70*b*, respectively). In response to sensor 58*a* detecting the leading edge, LCU 24 activates motor 52*a* to rotate its urging roller 56*a* and advance the sheet, in process 72*a*; similarly, and independently, in response to sensor 58*b* detecting the sheet leading edge, LCU 24 activates motor 52*b* to rotate its urging roller 56*b* and advance the sheet, in process 72*b*. This activation of motors 52*a*, 52*b* is effected by LCU 24 via motor drivers 50*a*, 50*b* (FIG. 4).

Registration station 45 is now ready to effect the desired skew adjustment, as well as conventional skew correction for any undesired skew in the sheet, responsive to the sensing of the leading edge of a media sheet by sensors 60*a*, 60*b*. Referring first to the left side, the leading edge of the media sheet is sensed by sensor 70*a* as it is advanced through registration 45 by activated motor 52*a* and urging roller 56*a*. In response to this detection, which is communicated by sensor 60*a* to LCU 24, LCU 24 waits for the delay time calculated in process 87, which amounts to the null delay time plus or minus the delay corresponding to the skew adjustment. Upon the elapse of that delay time, LCU 24 then issues a signal to motor driver 50*a* to deactivate motor 52*a*, in process 91*a*.

Similarly, the leading edge of the sheet reaching sensor 60*b* is detected in process 74*b*, at such time as that edge arrives. LCU 24 then effects the calculated delay, in process 90*b*, such delay similarly amounting to the null delay time plus or minus the adjustment calculated in process 87. Upon the elapse of this delay time, LCU 24 then deactivates motor 52*b*, in process 91*b*.

The operation of processes 74, 76 thus effect both the correction of undesired skew, and the implementation of desired skew adjustment selected by the operator in process 64. The sensing by downstream sensors 60*a*, 60*b* and the corresponding differential deactivating of motors 52*a*, 52*b* in response to this sensing theoretically removes skew in the media sheet. This is because the later of the two motors 52 to be deactivated continues to rotate its corresponding urging roller 56 while the other is stopped, rotating the paper and correcting the skew. Theoretically, this removes skew in the sheet as it is registered. However, this skew removal may not be exact in practice, considering machine tolerances, machine wear, temperature variations, and other sources of mechanical error.

According to this invention, however, the skew removal is adjustable under operator control, by the invoking of the skew adjustment applet in process 62 and the selection of a skew adjustment by the operator in process 64. It is contemplated that this skew adjustment will typically be made by the operator in a trial and error manner, by the operator running printed test pages, iteratively making skew adjustments, and inspecting the printed output to select the desired skew adjustment. As described above, in this embodiment of the invention, the timing of the deactivation of motors 52 is adjusted in response to the selected skew adjustment, providing a fine tuning of the skew adjustment. In this manner, the operator of printing machine 10 can thus tune out even extremely small skew error, providing a highly precise printed output.

Referring back to FIG. 5, upon completion of process 76 (i.e., processes 76*a*, 76*b* of FIG. 7), LCU 24 executes decision 78 to determine whether additional pages remain to be printed in the current print job. If so (decision 78 is YES), control of registration station 45 returns to process 70, in which the leading edge of the next media sheet is sensed and the process, including skew removal and adjustment, is repeated. Upon no further pages remaining to print (decision 78 is NO), the process is complete.

In the alternative to skew adjustment being effected by differential delay of the deactivation of motors 52, skew adjustment may also be effected as stepper motors 52*a*, 52*b* are activated. In this approach, the timing of the activation of motors 52*a*, 52*b* is differentially adjusted in response to the desired skew adjustment entered by the operator. This skew adjustment on activation may be applied either in combination with, or alternatively instead of, the skew adjustment at deactivation described above relative to FIG. 7. It is contemplated that those skilled in the art having reference to this specification will be able to select between either or both of these approaches, for a given printing machine architecture and operation.

Further in the alternative, it is contemplated that the skew adjustment can be effected by differentially controlling the angular velocity with which each of the urging rollers advances the media sheet. As described in the above-incorporated U.S. Pat. No. 5,078,384 and U.S. Pat. No. 5,094,442, some printing machines effect registration of the media by controlling the velocity of the motors that drive the urging rollers in the registration station, with differential velocities effecting a rotation of the media. In this further alternative implementation, LCU 24 computes a difference in the differential velocity of the registration motors according to the user skew adjustment input. The motors are thus controlled accordingly, finely tuning the rotation of the media. While this approach involves a more complicated calculation, it is contemplated to be well within the capability of modern electronic logic circuitry.

Still further in the alternative, it is contemplated that this invention may be applied at various locations within the printing machine. For example, it is contemplated that a downstream registration function may also be implemented at the transfer station, for example to finely adjust the registration of the media after the registration station has transferred the media to the transfer station; it is contemplated that this invention may be implemented at such a downstream location as well. It is also contemplated that the transfer station and registration station can be mechanically combined into the same station, in which this invention may also be implemented. It is contemplated that these and other alternative implementations of the invention will be apparent to those skilled in the art having reference to this specification.

In each case, this invention provides the important advantage of allowing the operator of the printing machine to make precise adjustments in the skew of media printed by the printing machine. This eliminates the need for a service technician to effect this adjustment, saving cost and downtime, while providing improved precision in the positioning of printed images by the printing machine. This invention thus extends the precision of conventional printing machines, without further constricting the manufacturing tolerances of the equipment components.

While the present invention has been described according to its preferred embodiments, it is of course contemplated that modifications of, and alternatives to, these embodiments, such modifications and alternatives obtaining the advantages and benefits of this invention, will be apparent to those of ordinary skill in the art having reference to this specification and its drawings. It is contemplated that such modifications and alternatives are within the scope of this invention as subsequently claimed herein.

What is claimed is:

1. A method of correcting for skew of a media sheet in a printing machine, comprising the steps of:

receiving a skew adjustment value;

advancing a media sheet along a transport path using at least two laterally spaced urging mechanisms;

sensing a position of the media sheet;

differentially operating the urging mechanisms responsive to the sensed position of the media sheet and to the skew adjustment value; and then transferring an image to the media sheet.

2. The method of claim 1, wherein the sensing step comprises:

sensing an edge of the media sheet at a plurality of locations along the transport path.

3. The method of claim 2, wherein the advancing step comprises:

driving first and second laterally spaced urging rollers that are in contact with the media sheet, to advance the media sheet along the path.

4. The method of claim 3, wherein the sensing step comprises:

sensing an edge of the media sheet at first and second spaced apart sensing locations, the first sensing location associated with the first urging roller and the second sensing location associated with the second urging roller.

5. The method of claim 4, further comprising:

calculating first and second delay times corresponding to the skew adjustment value;

and wherein the differentially operating step comprises:

deactivating a first motor driving the first urging roller responsive to sensing an edge of the media sheet at the first sensing location, after the first delay time; and deactivating a second motor driving the second urging roller responsive to the sensing an edge of the media sheet at the second sensing location, after the second delay time.

6. The method of claim 4, further comprising:

calculating first and second delay times corresponding to the skew adjustment value;

and wherein the differentially operating step comprises:

activating a first motor driving the first urging roller responsive to sensing an edge of the media sheet at the first sensing location, after the first delay time; and activating a second motor driving the second urging roller responsive to the sensing an edge of the media sheet at the second sensing location, after the second delay time.

7. The method of claim 3, further comprising:

calculating first and second angular velocities corresponding to the skew adjustment value;

wherein the differentially operating step comprises:

driving the first urging roller at the first angular velocity; and driving the second urging roller at the second angular velocity.

8. The method of claim 1, wherein the receiving step comprises:

receiving a skew adjustment value as an input signal from a user interface.

9. The method of claim 1, wherein the receiving step comprises:

receiving a skew adjustment value over a computer network.

10. A printing machine, comprising:

a photoconductor;

an exposure station, for effecting a charge pattern at a portion of the photoconductor, the charge pattern corresponding to an image to be printed;

a developer station, for electrostatically adhering toner to the photoconductor in a toner pattern corresponding to the charge pattern effected by the exposure station;

a registration station, for aligning a media sheet relative to a transfer path, the registration station comprising:

first and second laterally spaced urging rollers, for advancing the media sheet along the transfer path;

first and second motors for driving the first and second urging rollers, respectively; and a plurality of sensors for sensing the position of the media sheet at the registration station;

a transfer station, for transferring toner in the toner pattern from the photoconductor to media sheets received from the registration station;

an input device for receiving a skew adjustment value;

a fuser station, comprising a fuser roller, for applying pressure to the receiver sheet so that the toner fuses to the media sheet in the toner pattern; and control circuitry, coupled to the plurality of sensors and to the first and second motors of the registration station, programmed to adjust the position of media sheets at the registration station by performing a plurality of operations comprising:

receiving the skew adjustment value from the input device;

receiving signals from the plurality of sensors indicating a position of the media sheet at the registration station;

differentially operating the urging mechanisms responsive to the sensed position of the media sheet and to the skew adjustment value, to position the media sheet in the transfer path.

11. The printing machine of claim 10, wherein the input device comprises an interactive user interface.

12. The printing machine of claim 10, wherein the input device comprises a network interface.

13. The printing machine of claim 10, wherein the plurality of sensors comprise first and second laterally spaced sensors disposed on either side of a center line of the transfer path at the registration station.

14. The printing machine of claim 10, wherein the urging mechanisms comprise:

a first urging roller disposed at a lateral distance from a center line of the transfer path;

a first motor for driving the first urging roller responsive to control signals from the control circuitry;

a second urging roller laterally spaced from the first urging roller on an opposite side of the center line of the transfer path; and a second motor for driving the second urging roller responsive to control signals from the control circuitry.

15. The printing machine of claim 14, wherein the plurality of operations further comprises:

calculating first and second delay times corresponding to the skew adjustment value;

after the first delay time following the first sensor sensing an edge of the media sheet, deactivating the first motor; and after the second delay time following the second sensor sensing an edge of the media sheet, deactivating the second motor.

16. The printing machine of claim 14, wherein the plurality of operations further comprises:

calculating first and second delay times corresponding to the skew adjustment value;

after the first delay time following the first sensor sensing an edge of the media sheet, activating the first motor; and after the second delay time following the second sensor sensing an edge of the media sheet, activating the second motor.

17. The printing machine of claim 14, wherein the plurality of operations further comprises:

calculating first and second angular velocities corresponding to the skew adjustment value;

driving the first urging roller at the first angular velocity; and driving the second urging roller at the second angular velocity.

* * * * *